US010266991B2

(12) United States Patent
Brunninger

(10) Patent No.: US 10,266,991 B2
(45) Date of Patent: Apr. 23, 2019

(54) VEHICLE COMBINATION FOR CLEANING BALLAST ON A TRACK

(71) Applicant: Plasser & Theurer Export von Bahnbaumaschinen Gesellschaft m.b.H., Vienna (AT)

(72) Inventor: Manfred Brunninger, Altenberg (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 3 days.

(21) Appl. No.: 15/104,378

(22) PCT Filed: Dec. 29, 2014

(86) PCT No.: PCT/EP2014/003472
§ 371 (c)(1),
(2) Date: Jun. 14, 2016

(87) PCT Pub. No.: WO2015/106793
PCT Pub. Date: Jul. 23, 2015

(65) Prior Publication Data

US 2016/0312411 A1 Oct. 27, 2016

(30) Foreign Application Priority Data

Jan. 15, 2014 (AT) ..... A 25/2014

(51) Int. Cl.
*E01B 27/10* (2006.01)

(52) U.S. Cl.
CPC ..... *E01B 27/10* (2013.01)

(58) Field of Classification Search
CPC ..... E01B 27/10
(Continued)

(56) References Cited

U.S. PATENT DOCUMENTS 5,090,483 A * 2/1992 Theurer et al. ..... E01B 27/026 104/279
6,619,405 B2 * 9/2003 Theurer et al. ..... E01B 27/105 104/7.3

(Continued)

FOREIGN PATENT DOCUMENTS

AT 235 328 B 8/1964
CN 103052750 A 4/2013

(Continued)

OTHER PUBLICATIONS

International Search Report of PCT/EP2014/003472, dated Mar. 26, 2015.

*Primary Examiner* — Thomas B Will
*Assistant Examiner* — Joel F. Mitchell
(74) *Attorney, Agent, or Firm* — Collard & Roe, P.C.

(57) ABSTRACT

A vehicle combination for cleaning ballast on a track consists of a first ballast-collecting vehicle at the front with respect to a working direction, equipped with two edge-clearing chains which are mutually opposed across the width of the track and are designed to collect the ballast lying in a track bed region adjacent to the sleeper ends, and also consists of a subsequent second ballast-collecting vehicle having a continuous clearing chain that can be placed around the track to collect the ballast lying under the track, and comprising sieve systems for cleaning the ballast. In front of the first ballast-collecting vehicle there are two mutually separable sieve vehicles disposed one behind the other in a longitudinal direction of the machine and each having a sieve system. The two sieve vehicles can be loaded via a first conveyor belt line with ballast collected by the ballast-collecting vehicles. The two ballast-collecting vehicles are connected by a detachable coupling arrangement and linked
(Continued)

Figure 1:
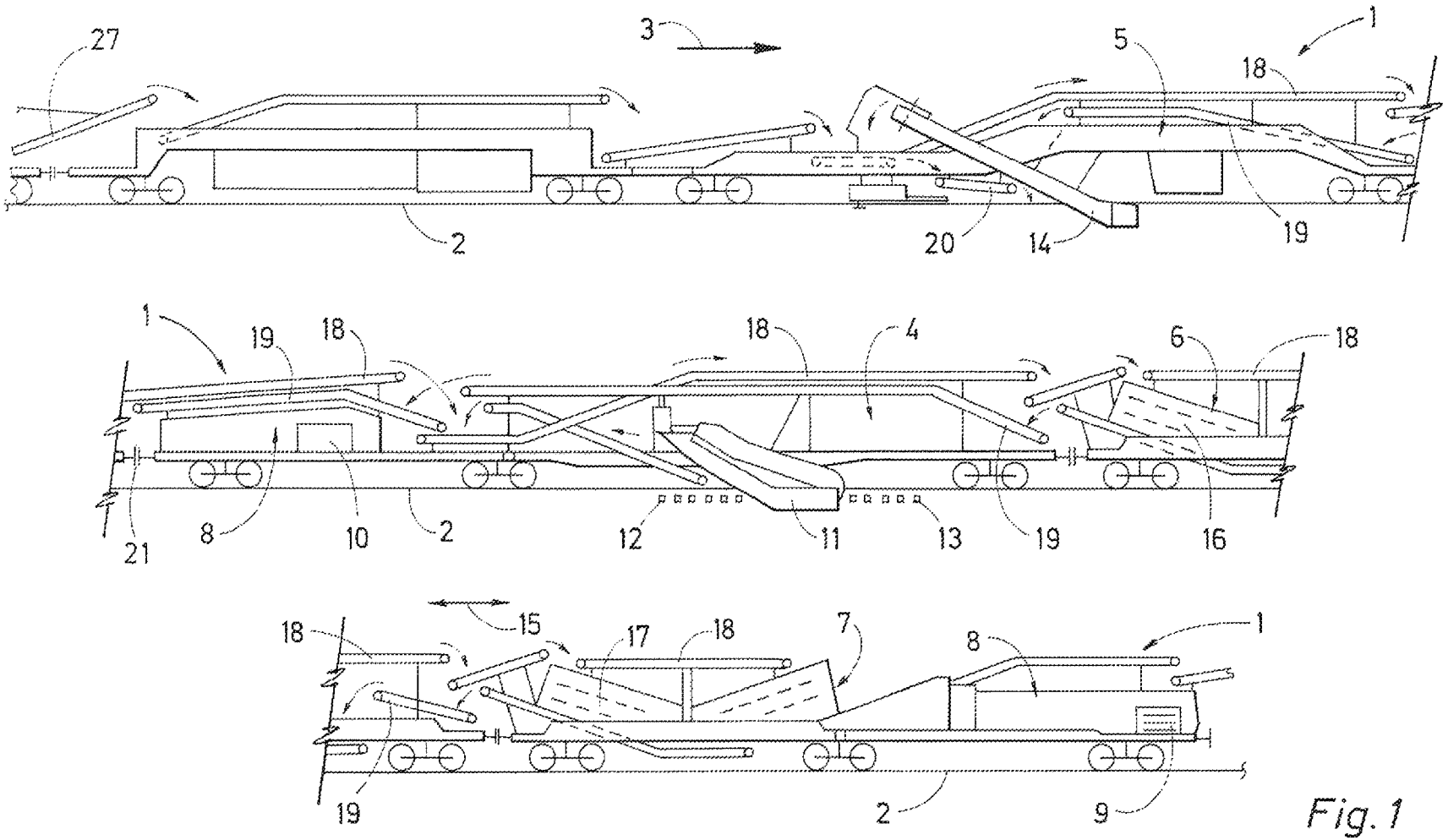

to a second conveyor belt line for transporting cleaned ballast to discharge arrangements.

2 Claims, 2 Drawing Sheets

(58) Field of Classification Search
USPC ..... 171/16; 37/107; 104/7.3
See application file for complete search history.

(56) References Cited

U.S. PATENT DOCUMENTS

| | | | | |
|---|---|---|---|---|
| 6,672,398 | B2 * | 1/2004 | Theurer et al. | E01B 27/105 104/7.1 |
| 7,739,811 | B2 * | 6/2010 | Theurer et al. | E01B 27/105 104/7.3 |
| 9,416,509 | B2 | 8/2016 | Theurer et al. | |
| 2013/0186656 | A1 | 7/2013 | Theurer et al. | |

FOREIGN PATENT DOCUMENTS

| | | | |
|---|---|---|---|
| CN | 103459723 | A | 12/2013 |
| EP | 0408837 | A1 | 1/1991 |
| EP | 2 025 810 | A1 | 2/2009 |
| GB | 970010 | A | 9/1964 |
| WO | 2012/136297 | A1 | 10/2012 |

* cited by examiner

VEHICLE COMBINATION FOR CLEANING BALLAST ON A TRACK

CROSS REFERENCE TO RELATED APPLICATIONS

This application is the National Stage of PCT/EP2014/003472 filed on Dec. 29, 2014, which claims priority under 35 U.S.C. § 119 of Austrian Application No. A 25/2014 filed on Jan. 15, 2014, the disclosures of which are incorporated by reference. The international application under PCT article 21(2) was not published in English.

The invention relates to a vehicle combination for cleaning ballast of a track, consisting of a front, first ballast pick-up vehicle—with regard to a working direction—which is equipped with two shoulder clearing chains, disposed opposite one another in a transverse direction of the track for picking up the ballast located in a track bed region adjoining sleeper ends, and further consisting of a following second ballast pick-up vehicle having an endless chain guidable around the track, for picking up the ballast located underneath the track, and of screening installations for ballast cleaning.

A machine of this type is known from EP 0 408 837. As a result of combining shoulder clearing chains arranged in front with an endless clearing chain, it is possible to achieve a particularly high cleaning performance.

It is the object of the present invention to provide a vehicle combination of the type mentioned at the beginning which enables a more varied utilization of the machine.

According to the invention, this object is achieved with a vehicle combination of the specified kind by way of the features cited in the characterizing part of the main claim.

Due to this special combination of features there is now the advantageous possibility to split a special high-performance machine, if needed, into two cleaning machines, each of which can be deployed without restriction. Implementing this conversion into two separately operable machines essentially only requires a slightly altered grouping of the individual vehicles. This new arrangement is advantageous particularly when a greater number of switches is present in the track section to be cleaned. In this case, it would not be possible to employ the shoulder clearing chains, and the very long combination machine would be rather unwieldy.

Additional advantages of the invention become apparent from the dependent claims and the drawing description.

The invention will be described in more detail below with reference to an embodiment represented in the drawing.

Figure 2:
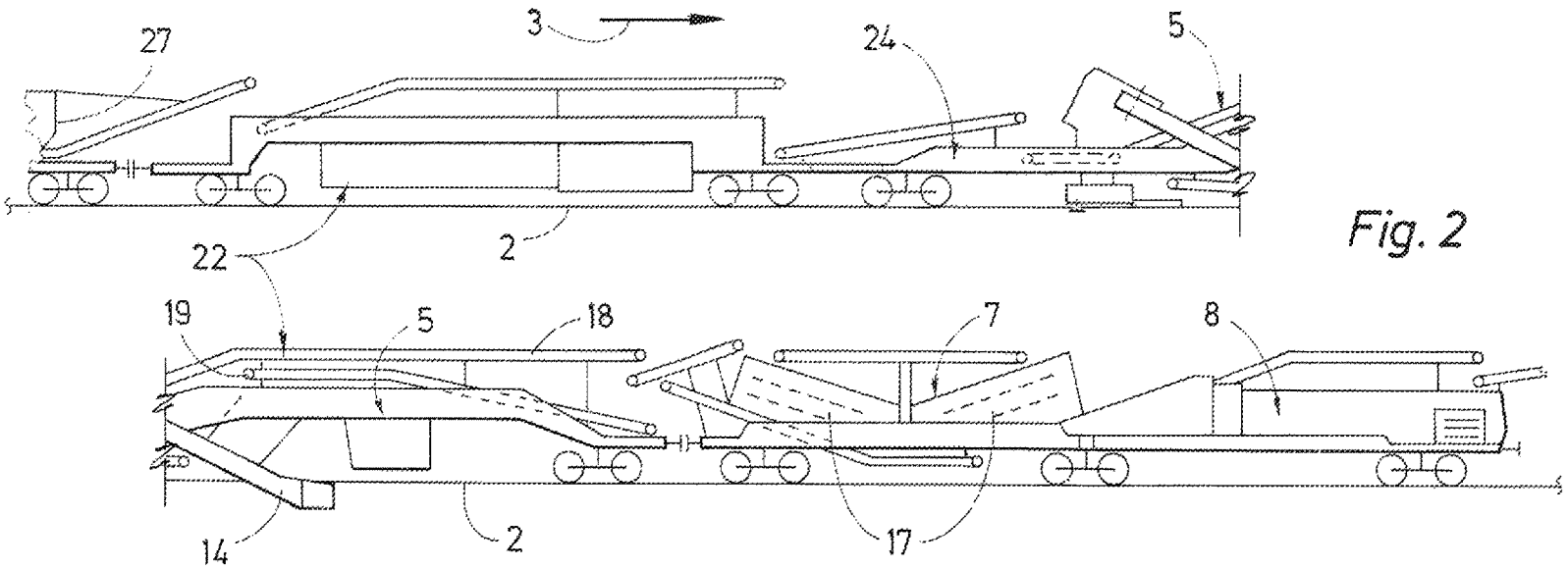
Figure 3:
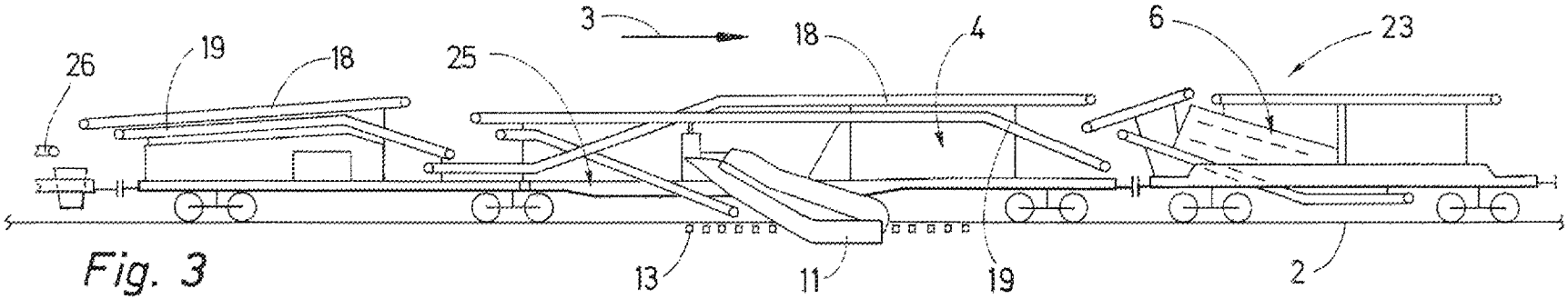

FIG. 1 is side view—shown in three parts for reasons of space—of a vehicle combination according to the invention, and FIGS. 2 and 3 each show a partial combination or working unit which can be assembled from the former.

A vehicle combination 1 shown in FIG. 1 for cleaning ballast of a track 2 is mobile on the same in a working direction 3 and is essentially composed of a first ballast pick-up vehicle 4 which is in front with regard to the said direction, a following second ballast pick-up vehicle 5, and two screening vehicles 6 and 7. Additionally, power units 8 having energy sources 9 and hydraulic plants 10 are incorporated into the vehicle combination 1.

The first ballast pick-up vehicle 4 is equipped with two shoulder clearing chains 11 which are arranged at both longitudinal sides of the vehicle 4, lying opposite one another in a transverse direction of the track. These shoulder clearing chains 11 serve for picking up that ballast which is located in a track bed region adjoining sleeper ends 12 of sleepers 13 of the track 2. The second ballast pick-up vehicle 5 has an endless clearing chain 14 which can be guided around the track 2 during working operations and is designed for picking up the ballast located underneath the track 2.

The two screening vehicles 6, 7 are arranged preceding the first ballast pick-up vehicle 4 in the working direction 3 and following one another—with regard to a longitudinal direction 15 of the machine—and are designed to be separable from one another, each having a screening installation 16 or 17 for ballast cleaning. A first conveyor belt road 18 is provided for charging the two screening vehicles 6, 7 with the ballast picked up by the two ballast pick-up vehicles 4 and 5. A second conveyor belt road 19 for transporting cleaned ballast to discharge devices 20 is associated with the two ballast pick-up vehicles 4 and 5 which are connected to one another by a releasable coupling device 21. The discharge devices 20 for discharging the cleaned ballast are arranged rearward—with regard to the working direction 3—of the endless clearing chain 14 of the second ballast pick-up vehicle 5. Additionally, new ballast can be brought in via storage wagons 27 coupled to the rear end of the vehicle combination 1.

As already mentioned, the vehicle combination 1 can be divided, when needed, into two separate working units 22, 23 which are operable independently of one another and are depicted in FIGS. 2 and 3, respectively. FIG. 2 shows a unit 22 which consists of a combination of the second ballast pick-up vehicle 5 with the screening vehicle 7 located at the front in the working direction 3, together with the power unit 8. The cleaning machine 24 thus formed is suited especially for operation in tracks 2 having switches and is particularly efficient due to the screening plant 17 being equipped with a double screen. Said efficiency is even enhanced by the fact that the shoulder clearing chains 11—which cannot be employed in switch sections—of the first ballast pick-up vehicle 4 are not present here and thus cannot pose an obstruction slowing down the work progress.

As depicted in FIG. 3, said first ballast pick-up vehicle 4 together with the other screening vehicle 6 forms a second working unit 23 which can now be employed as a cleaning machine 25—independently of the unit 22—especially for cleaning track bed shoulders. In this case, a ballast discharge wagon 26 is attached which now takes over the task of the discharge device 20.

The invention claimed is:

1. A vehicle combination for cleaning ballast of a track, the vehicle combination comprising:

a first working unit comprising:

a front first vehicle comprising a first ballast pick-up vehicle, disposed in a front region with regard to a working direction, a first set of shoulder clearing chains, disposed on the first working unit opposite one another in a transverse direction of the track, configured to pick up the ballast located in a track bed region adjoining sleeper ends, at least one first screening vehicle proceeding said first ballast pick-up vehicle a second working unit comprising:

a second ballast pick-up vehicle having an endless chain, guidable around the track, for picking up the ballast located underneath the track, and of screening installations for ballast cleaning, at least one second screening vehicle;

wherein the vehicle combination comprises the following features:

a) two screening vehicles preceding the first ballast pick up vehicle wherein the two screening vehicles are arranged one following the other with regard to a longitudinal direction of the vehicle combination and are separable from one another, each having a screening installation;

b) a first conveyor belt road wherein both screening vehicles can be charged via said first conveyor belt road with ballast picked up by both ballast pick-up vehicles, c) a second conveyor belt road associated with both ballast pick-up vehicles which are connected to one another by a releasable coupling device, wherein said second conveyor belt road is configured to transport cleaned ballast to discharge devices;

d) wherein the vehicle combination is divided into two separate working units which are operable independently of one another, wherein a first unit forming a cleaning machine which comprises a combination of the second ballast pick-up vehicle with the screening vehicle of said two screening vehicles and a second unit forming a cleaning machine which comprises a combination of the first ballast pick-up vehicle with another screening vehicle of said two screening vehicles.

2. The vehicle combination according to claim 1, wherein the discharge devices for discharging the cleaned ballast are arranged rearward, in the working direction, of the endless chain of the second ballast pick-up vehicle.

* * * * *